US005836037A

United States Patent [19]

Monahan

[11] Patent Number: 5,836,037

[45] Date of Patent: Nov. 17, 1998

[54] PLASTIC SLEEVE FOR WIRE WOUND BROOM

[75] Inventor: Jon Monahan, Arcola, Ill.

[73] Assignee: The Thomas Monahan Co., Arcola, Ill.

[21] Appl. No.: 651,844

[22] Filed: May 21, 1996

[51] Int. Cl.[6] ..... A46B 3/08; A46B 3/16

[52] U.S. Cl. ..... 15/189; 15/171; 15/174

[58] Field of Search ..... 15/159.1, 171, 15/174, 175, 189, 207

[56] References Cited

U.S. PATENT DOCUMENTS

| | | | |
|---|---|---|---|
| 91,907 | 6/1869 | Burnett . | |
| 117,192 | 7/1871 | Middleton . | |
| 148,278 | 3/1874 | Anderson et al. . | |
| 181,455 | 8/1876 | Lee, Jr. . | |
| 187,346 | 2/1877 | Barrett . | |
| 267,444 | 11/1882 | Flint . | |
| 674,899 | 5/1901 | Bradt et al. . | |
| 931,290 | 8/1909 | Frazier . | |
| 949,577 | 2/1910 | Karst . | |
| 4,087,880 | 5/1978 | Clark, Jr. . | |
| 4,541,139 | 9/1985 | Jones et al. | 15/171 |
| 4,642,837 | 2/1987 | Nichols et al. | 15/171 |
| 5,371,916 | 12/1994 | Vosbikian . | |
| 5,590,437 | 1/1997 | McMillan | 15/189 |

*Primary Examiner*—Terrence Till
*Attorney, Agent, or Firm*—R. William Graham

[57] ABSTRACT

A broom having a handle with a threaded end and a broom head connected to the handle which includes a generally cylindrical sleeve made of plastic having a first end which defines an open surface extending axially therethrough and a second end which defines a forward threaded open surface extending axially therethrough in communication with the open surface of the first end, wherein the open surfaces are configured to receive the threaded end of the handle and wherein the sleeve is employed in a method for winding a broom head which includes mating the sleeve to a forward threaded shaft, fixing the position of the sleeve to the shaft, disposing broom corn about the sleeve, securing an end from a winding wire through the broom corn to the sleeve, clockwise rotating the shaft such that the winding wire wraps about the broom corn in a manner to secure the broom corn to the sleeve and connecting another end of the wire to the sleeve.

9 Claims, 3 Drawing Sheets

PLASTIC SLEEVE FOR WIRE WOUND BROOM

BACKGROUND OF THE INVENTION

1. Field of the Invention

The present invention relates to improvements in brooms wherein the broom head is made separate from the handle. More particularly, the invention relates to a novel broom having a broom head which includes a broom head sleeve and method of making a broom employing the same.

2. Related Art

The art of broom making is very extensive including myriads of designs for various purposes. Brooms commonly include a handle and broom head which has a plurality of debris gathering fibers. The fibers are arranged in rows in a side by side lengthwise manner and are bound together and attached to the handle directly or to a head which is then attached to the handle.

To save in costs of packaging, shipping and shelf storage space, various designs for separate broom heads and handles have been made. This is desirable to the consumer for reasons that a consumer may need only replacement of a worn broom head or a broken handle.

Nevertheless, the art of making conventional wooden handle brooms with sewn broom corn fibers wound to the handle has remained popular and relatively unchanged. This is due to the fact that such broom making equipment is relatively simple and provides a consumer with an inexpensive product. In making such brooms, broom corn fibers are placed adjacent an end of the handle to become the broom head and a piece of winding is tacked through the broom corn fibers to the wooden handle end. A clockwise rotatable collet attaches to another end of the wooden handle and the handle is rotated to draw the winding about the broom corn fibers in a manner to secure the broom corn fibers to the handle wherein a terminal end of the winding is stapled or tacked to the wooden handle.

There is a desire and need to continue making this type of broom yet have a separate broom head and handle, and, for the reasons stated, employ the described conventional broom making equipment to accomplish the same. Additionally, it is desired that broom handles be made from other materials, such as metal or plastic, and integrated into the conventional broom making process. Presently, no such methods or devices are available to satisfactorily accomplish this.

BRIEF SUMMARY OF THE INVENTION

It is an object to improve brooms.

It is another object to improve broom manufacturing.

It is an object to solve the need described above by providing a wound broom corn type broom with a separable head and handle.

Other objects and advantages will be readily apparent to those skilled in the art upon viewing the drawings and reading the detailed description hereafter.

DETAILED DESCRIPTION OF THE INVENTION

Figure 1:
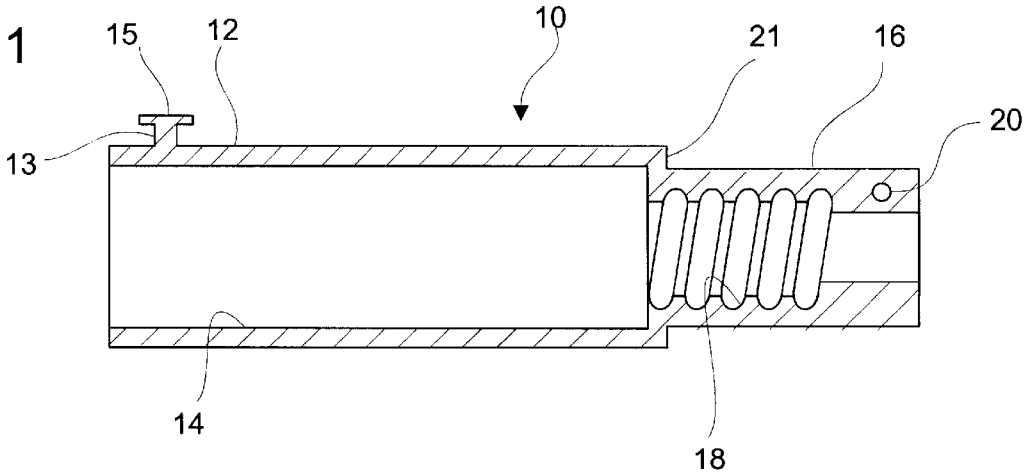
FIG. 1 shows a cross section of a broom sleeve of the present invention.

Referring to the drawings, the present invention includes a generally cylindrical sleeve 10 for use in a novel method of making a wound broom corn type broom. As seen in FIG. 1, the sleeve 10 is preferably made of material, such as moldable plastic. The sleeve 10 has a first end 12 which defines an open surface 14 extending axially therethrough and a second end 16 which defines a forward threaded open surface 18 extending axially therethrough and in communication with the open surface 14 of the first end 12. The first end 12 has integrally formed on an outer surface thereof a stud 13 having a head 15 to retain the wire 40 as described below. The second end 16 has a bored surface 20 extending radially therethrough. The outer diameter of the first end 12 is slightly larger than the outer diameter of the second end, thus forming a shoulder 21 therebetween.

Figure 2:
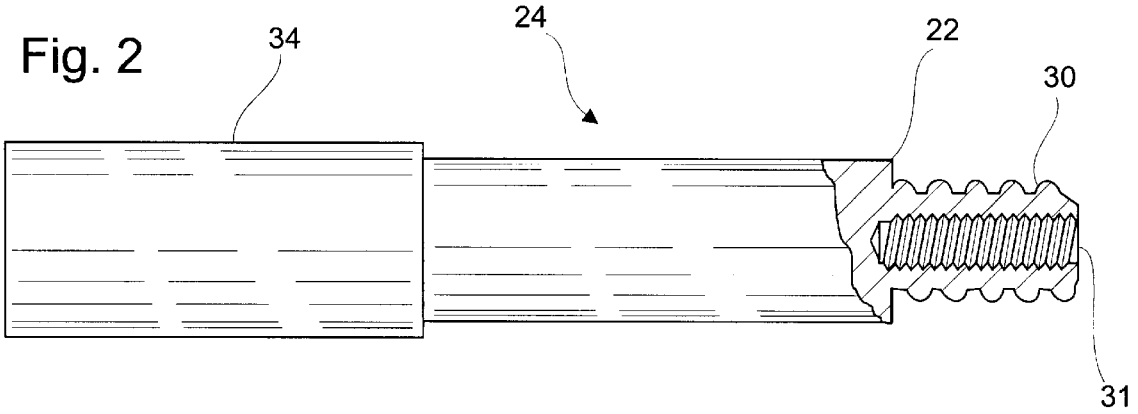
FIG. 2 shows a shaft for use in the method of the present invention.
Figure 7:
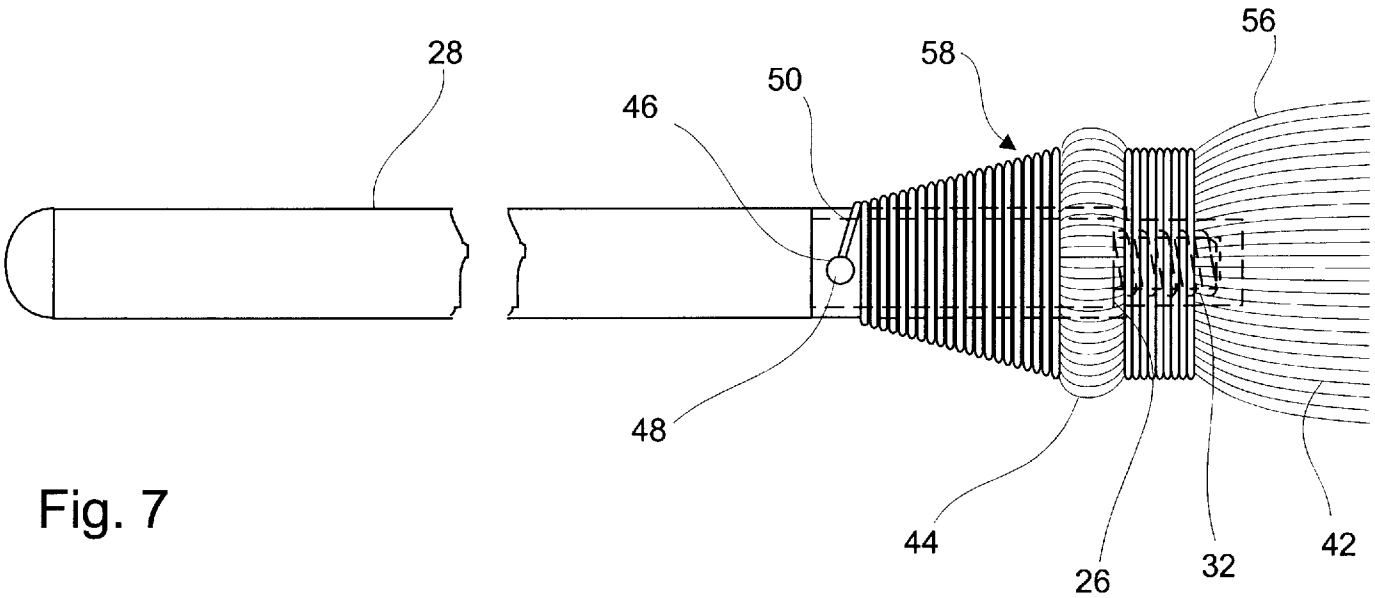
FIG. 7 shows a wooden handle inserted into the broom head depicted in FIG. 5 to form a broom.
Figure 5:
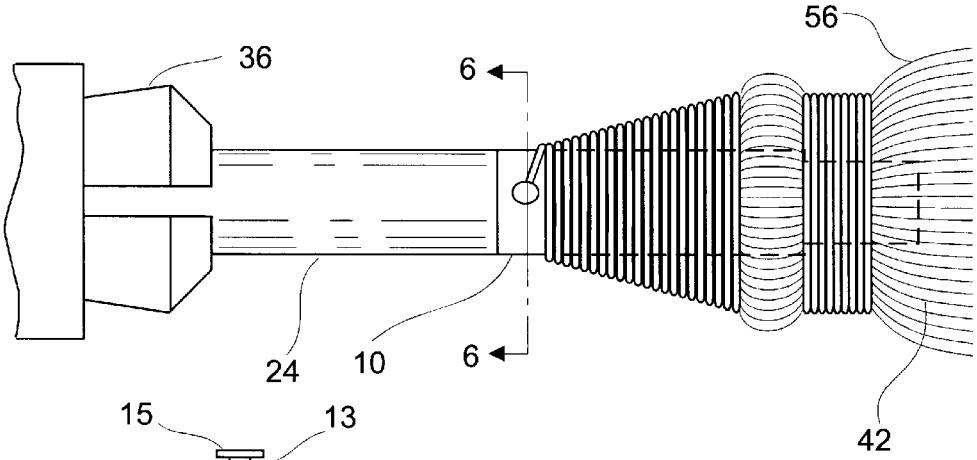
FIG. 5 shows winding about broom corn fibers having been attached to the sleeve to form a broom head.
Figure 6:
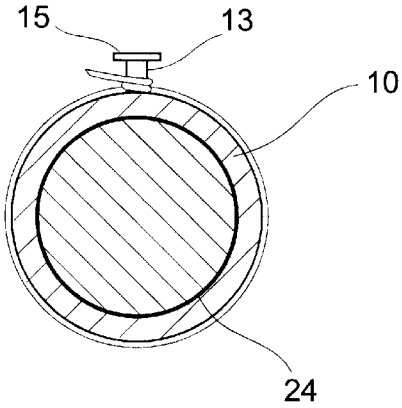
FIG. 6 shows a cross section of the sleeve, shaft and stud at line 6—6 in FIG. 5.

The open surfaces 14 and 18 are configured to receive an end 22 of shaft 24, as seen in FIG. 2, or end 26 of a broom 28 as seen in FIG. 7. Each of the ends 22 and 26 have a forward threaded surface 30 and 32, respectively, to thread to the threaded surface 18.

Figure 3:
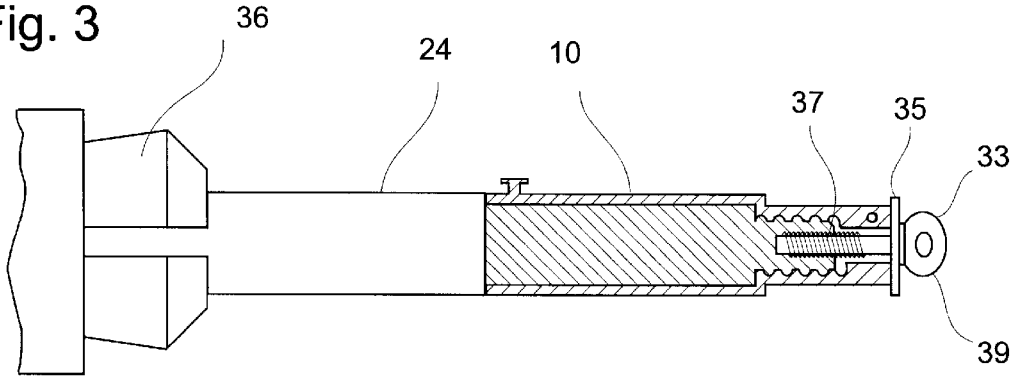
FIG. 3 shows the sleeve of FIG. 1 disposed on the shaft of FIG.2 which is fixed to a collet with a threaded eyebolt for use in the present invention.

The shaft 24 is made of any suitable material, such as metal or plastic, to carry out the invention. The shaft 24 has an end 34 which is fixably connectable to a motorized rotatable collet 36, as seen in FIG. 3, wherein the collet 36 is connectable to a power source (not shown) to enable the shaft 24 to be conventionally clockwise rotated. The end 30 has an open threaded surface 31 to receive a threaded eyebolt 33 for reasons apparent hereinafter and a washer 35 is also provided in preventing damage to the sleeve 10 in carrying out the winding process. The washer 35 has an opening slightly larger than a threaded portion 37 of the eyebolt 33 to receive the same therethrough but smaller than the eyelet head 39.

In carrying out the invention, the sleeve 10 is threadably connected to the shaft 24 which is in turn connected to the collet 36. Since the collet 36 is geared to rotate clockwise, the threaded portion 37 of the eyebolt 33 is inserted through the opening of the washer 35 and open surface 18 and threaded to the threaded opening 31. The eyebolt 33 is threaded to tightly draw the sleeve 10 tight to the shaft 24 and prevent unthreading from each other during the winding process. The washer 35 is provided between the eyebolt 33 and the end 20 to prevent any disfiguring of the end 20 by the eyelet head 39.

Figure 4:
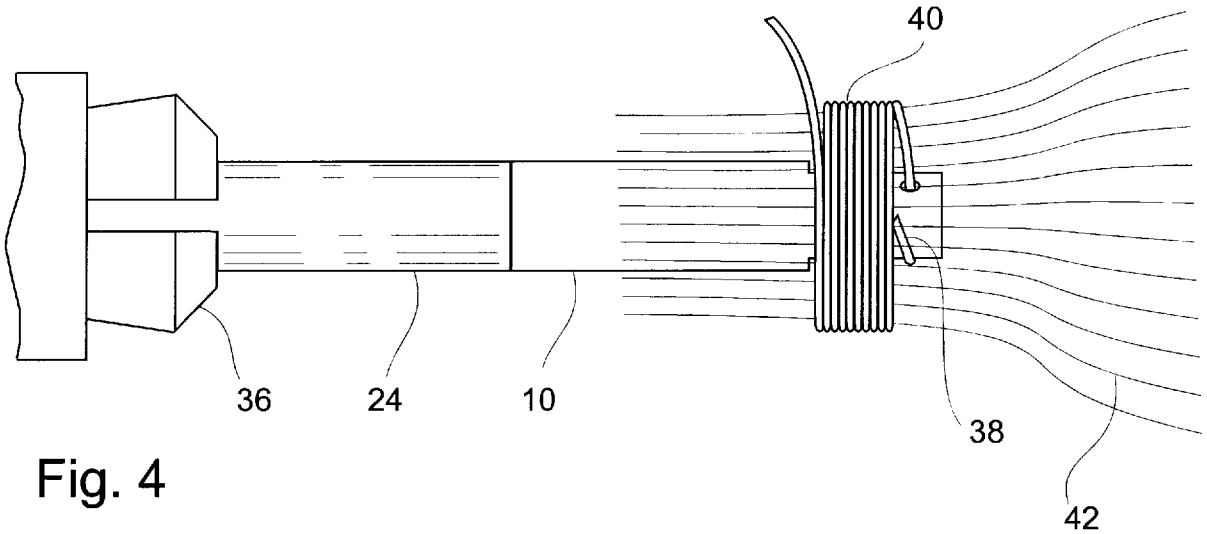
FIG. 4 shows winding about broom corn fibers being attached to the sleeve.

As seen in FIG. 4, an end 38 of winding wire 40 is passed through the bored surface 20 and tied off to secure the end 38 to the sleeve 10. Broom corn fibers 42 are placed adjacent the sleeve 10. While holding the wire 40 in a feeding manner, the collet 36 is powered to cause the rotation of the sleeve 10 in a clockwise direction. The forward threaded shaft 24 is prevented from backing out of or off of the sleeve 10 during the winding process as described above. As the sleeve 10 rotates, the wire 40 wraps about the broom corn 42 to tightly bind the same to the second end 16. The initial winding proceeds up to the shoulder 21 whereat a portion of the broom corn 44, as seen in FIG. 7, is left unbound. The winding continues about the remainder of the broom corn 42 and first end 12 of the sleeve 10 to a terminal point 46 of the sleeve 10. At this point, the rotation of the collet 36 and in turn the sleeve is stopped.

The integrally formed stud 13 positioned adjacent the terminal point is wrapped with a piece 50 of the wire 40 and tied off. The head 15 prevents the wire 40 from sliding off the stud 13. Any remainder of the wire 40 beyond piece 50 can be cut off.

At this point, the eyebolt 33 and washer 35 are removed. The newly formed broom head 56 is unthreaded from the shaft 24 and is threaded to the handle 28 to form a broom 58 contemplated by the present invention.

The above described embodiments are set forth by way of example and are not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. A broom corn fiber type broom, which includes:

a broom head having a generally cylindrical plastic sleeve having a first end which defines an open surface extending axially therethrough and a second end which defines axially therethrough a forward threaded open surface in communication with the open surface of the first end, a plurality of broom corn fibers having a portion thereof laterally extending along an outer surface of said sleeve, and means connected to said sleeve for binding said portion of said broom corn fibers to said sleeve; and a handle having an outer diameter less than a diameter of said open surface of said first end of said sleeve and having an end having an outer diameter less than a diameter of said threaded surface of said second end of said sleeve and threaded in a complimentary manner to be received therein, and wherein said handle is threadably connected to said broom head.

2. The broom of claim 1, wherein said binding means includes a radially extending bored surface through said second end of said sleeve, a wire having an end passing through said bored surface into and out of said open surface of said second end and tied to another portion of said wire, another portion of said wire wound about said broom corn fibers, and another end portion of said wire tied to an integrally formed stud which extends from said first end of said sleeve.

3. The broom of claim 1, wherein said first end of said sleeve has an outer diameter greater than an outer diameter of said second end forming a shoulder therebetween.

4. A broom corn fiber type broom, which includes:

a broom head having a removably connectable generally cylindrical sleeve having a first end which defines an open surface extending axially therethrough and a second end which defines axially therethrough a forward open retention surface in communication with the open surface of the first end, a plurality of broom fibers having a portion thereof laterally extending along an outer surface of said sleeve, and means connected to said sleeve for binding said potion of said broom fibers to said sleeve; and a handle having an outer diameter less than a diameter of said open surface of said first end of said sleeve and having an end having an outer diameter less than a diameter of said open retention surface of said second end of said sleeve and formed in a complimentary manner to be retained therein.

5. The broom of claim 4, wherein said open retention surface is threaded and said handle end is complimentary threaded to said retention surface.

6. The broom of claim 5, wherein said sleeve is plastic.

7. The broom of claim 4, wherein said binding means includes a radially extending bored surface through said second end of said sleeve, a wire having an end passing through said bored surface into and out of said open surface of said second end and tied to another portion of said wire, another portion of said wire wound about said broom corn fibers, and another end portion of said wire tied to an integrally formed stud which extends from said first end of said sleeve.

8. The broom of claim 4, wherein said first end of said sleeve has an outer diameter greater than an outer diameter of said second end forming a shoulder therebetween.

9. A broom corn fiber type broom, which includes:

a broom head having a generally cylindrical plastic sleeve having a first end which defines an open surface extending axially therethrough and a second end which defines axially therethrough a forward threaded open surface in communication with the open surface of the first end, a plurality of broom corn fibers disposed adjacent an outer surface of said sleeve, and means connected to said sleeve for binding said broom corn fibers to said sleeve, wherein said binding means includes a radially extending bored surface through said second end of said sleeve, a wire having an end passing through said bored surface into and out of said open surface of said second end and tied to another portion of said wire, another portion of said wire wound about said broom corn fibers, and another end portion of said wire tied to an integrally formed stud which extends from said first end of said sleeve; and a handle having an outer diameter less than a diameter of said open surface of said first end of said sleeve and having an end having an outer diameter less than a diameter of said threaded surface of said second end of said sleeve and threaded in a complimentary manner to be received therein, and wherein said handle is threadably connected to said broom head.

* * * * *